US006137236A

United States Patent [19]

Michiels et al.

[11] Patent Number: 6,137,236

[45] Date of Patent: Oct. 24, 2000

[54] LOW-PRESSURE DISCHARGE LAMP AND METHOD OF MANUFACTURING A LOW-PRESSURE DISCHARGE LAMP

[75] Inventors: Leonardus G. M. Michiels; Petrus F. J. Van Den Boom; Petrus H. Antonis, all of Eindhoven, Netherlands

[73] Assignee: U.S. Philips Corporation, New York, N.Y.

[21] Appl. No.: 09/203,696

[22] Filed: Dec. 2, 1998

[30] Foreign Application Priority Data

Dec. 3, 1997 [EP] European Pat. Off. ..... 97203789

[51] Int. Cl.[7] ..... H05B 41/16

[52] U.S. Cl. ..... 315/248; 315/344; 313/318.1

[58] Field of Search ..... 315/344, 248, 315/51, 52, 53, 54, 55, 56, 57, 58, 59, 60, 61, 62, 63; 313/318.1, 318.09, 318.01, 493, 634, 490

[56] References Cited

U.S. PATENT DOCUMENTS 4,262,231 4/1981 Anderson et al. .

5,723,947 3/1998 Popov et al. ..... 313/634

5,751,110 5/1998 Spaapen et al. ..... 313/350

5,811,914 9/1998 Eijkens ..... 313/51

5,912,536 6/1999 Michiels et al. ..... 315/248

5,994,837 11/1999 Willems et al. ..... 313/350

*Primary Examiner*—Don Wong

*Assistant Examiner*—Trinh Vo Dinh

*Attorney, Agent, or Firm*—F. Brice Faller

[57] ABSTRACT

A light-transmissive discharge vessel (1) encloses a discharge space (10) which contains an ionizable filling comprising an evaporable component. The low-pressure discharge lamp is also provided with coil for maintaining an electric discharge in the discharge space, and with a carrier (3) with a resilient body (30) and an open holder (31). The resilient body (30) is clamped inside a tube (14) which communicates with the discharge space (10). The holder (31) is clamped inside the resilient body (30). In the absence of the holder (31), the resilient body (30) can be inserted in a released state in the tube (14) with play (x).

7 Claims, 4 Drawing Sheets

LOW-PRESSURE DISCHARGE LAMP AND METHOD OF MANUFACTURING A LOW-PRESSURE DISCHARGE LAMP

BACKGROUND OF THE INVENTION

The invention relates to a low-pressure discharge lamp comprising a light-transmissive discharge vessel which encloses a discharge space with an ionizable filling in a gastight manner, which filling contains an evaporable component, and means for maintaining an electric discharge in the discharge space. A carrier with a resilient body is clamped inside a tube which is in communication with the discharge space, the carrier being suitable for containing the evaporable component.

The invention also relates to a method of manufacturing a low-pressure discharge lamp.

U.S. Pat. No. 4,262,231 discloses an electrodeless low-pressure mercury discharge lamp in which means for maintaining an electric discharge are formed by a torus-shaped coil in the discharge space. The ionizable filling contains mercury and a noble gas such as argon. In the known lamp, the carrier is embodied so as to be a rolled-up gauze which is moistened with an amalgam of mercury with an alloy such as PbBiSn. The tube in which the carrier is clamped is used, in the manufacture of the lamp, as an exhaust tube through which the discharge vessel is evacuated and filled. In the manufacture of the lamp, the rolled-up gauze, which also forms a resilient body, is inserted into the tube. This has the disadvantage that during inserting the gauze into the tube, scratches may be formed in said tube, which may lead to fracture.

SUMMARY OF THE INVENTION

According to the invention, the carrier includes not only the resilient body but also an open holder, which holder is clamped in the resilient body, and, in the absence of the holder, the resilient body can be accommodated in a released state in the tube with play.

In the manufacture of the lamp, the resilient body can be inserted in a released state into the tube. Since, in this state, there is some play between the holder and the tube, the formation of scratches in the tube is precluded. Subsequently, the holder can be clamped in the resilient body. As a result, the play between the resilient body and the tube is eliminated, so that the holder and the resilient body are both secured in the tube.

DE 25 11 417 AS discloses a low-pressure discharge lamp in which the carrier comprises a holder. The holder is used to dose mercury during the manufacture of the lamp. The resilient body is sealed at one end into an end portion of the discharge vessel and at its opposite end it clamps the holder to the wall of the exhaust tube. This lamp requires a separate operation to seal-in the resilient body. The choice of materials for the resilient body is limited to those which can suitably be sealed into glass.

An attractive embodiment of the low-pressure discharge lamp in accordance with the invention is characterized in that the resilient body is a strip which is incorporated between the holder and the tube. A resilient body of this shape is strong and easy to handle during the manufacture of the lamp.

It is favorable if the resilient body engages the tube with portions which are bent so as to be identical in shape to the internal surface of the tube, and if said resilient body has inwardly directed end portions. In this case, the pressure exerted by the resilient body on the tube is distributed over a relatively large surface area, so that a relatively thin tube can be used.

In an advantageous embodiment of the low-pressure discharge lamp, the holder and the resilient body have mutually self-locating shapes. By virtue thereof, the low-pressure discharge lamp can be manufactured by means of an attractive method in which a resilient body and a holder are inserted into a tube from mutually opposite ends, and the resilient body is held in the same axial position relative to the tube while the holder is inserted further until it is clamped in the resilient body, whereafter the tube and other components are assembled to form a discharge vessel, after which the discharge vessel is evacuated, and, subsequently, the discharge vessel is provided with a filling comprising an evaporable component, whereafter the tube is closed at a free end, the low-pressure discharge lamp, in this method, being provided with means for maintaining an electric discharge in the discharge space. Since the resilient body and the holder have mating shapes, the portions of the resilient body automatically spread outward in opposite directions as a result of the pressure exerted upon inserting the holder.

In the finished lamp, the holder may comprise an evaporable component, such as mercury or sodium in a bound form, for example, bound to an amalgam. The holder, which is clamped in the resilient body, is in a fixed position, so that the amalgam can function reliably. In an embodiment of said method, it is possible, in this case, to arrange first the holder with the amalgam in the tube. After assembly of the tube and the other parts, the discharge vessel of the lamp can be provided with the evaporable component, a part of which is bound by the amalgam.

In a favorable embodiment of this method, prior to evacuating the discharge vessel, the holder is closed and contains the evaporable component, the holder being opened after evacuation of the discharge vessel, for example by irradiating the holder with a laser beam. The holder may alternatively be opened by high-frequency heating. For this purpose, a glass capsule may be provided with a metal ring.

In an attractive variant of this embodiment, after opening the holder, the evaporable component is expelled from the holder, whereafter a tube portion containing the holder and the resilient body is detached from the tube, after which a resultant free end portion of the tube is sealed. This variant is very suitable if the holder is used exclusively for dosing the evaporable component. After expelling the evaporable component the holder no longer has a function. As a result of removing this tube portion, the remaining tube takes up relatively little space.

If mercury is used as the evaporable component, the resilient body may be manufactured from metals which are customarily used for low-pressure mercury discharge lamps and which do not form amalgam, such as niobium, tantalum, iron, nickel, chromium or alloys thereof, such as spring steel. The holder may also be manufactured from such a material, but may alternatively be made of glass.

Obviously, the nature of the means used to maintain the discharge is not essential to the substance of the invention. For example, it may be a pair of electrodes, which may, or may not, be arranged in the discharge vessel. The means may alternatively be a coil for generating, during operation, an alternating magnetic field in the discharge space. Preferably, the coil is arranged outside the discharge space in order to preclude electric lead-throughs passing through the discharge vessel.

These and other aspects of the low-pressure discharge lamp in accordance with the invention will be apparent from and elucidated with reference to the embodiments described hereinafter.

DETAILED DESCRIPTION OF THE PREFERRED EMBODIMENTS

Figure 1:
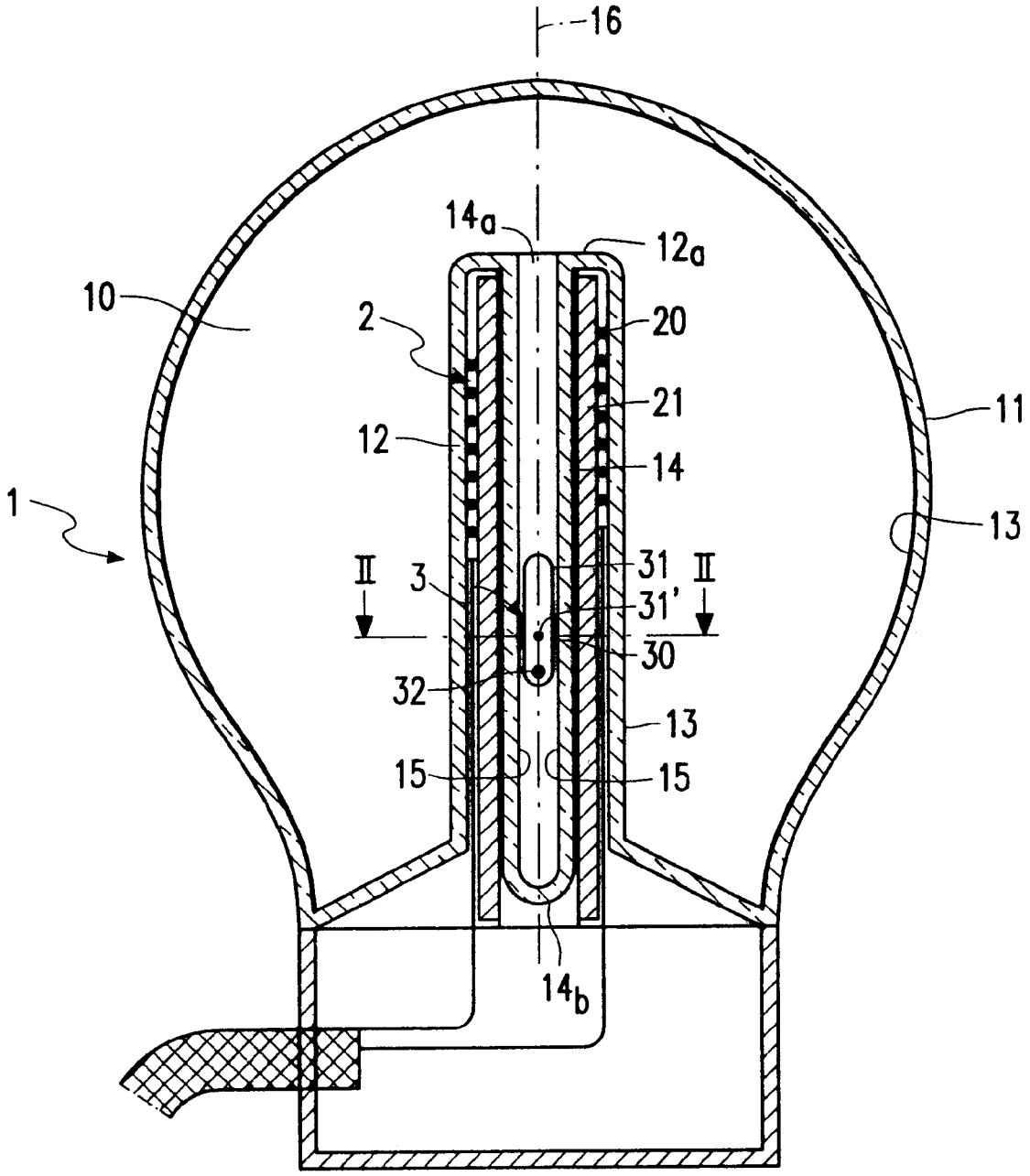
FIG. 1 is a cross-sectional elevation view first embodiment of the low-pressure discharge lamp in accordance with the invention.

The low-pressure discharge lamp shown in FIG. 1 comprises a light-transmissive discharge vessel 1 which encloses a discharge space 10 in a gastight manner. The discharge space 10 has an ionizable filling containing an evaporable component, in this case mercury with one or more noble gases. The discharge vessel 1 comprises an enveloping portion 11 and an indented portion 12. The enveloping portion 11 and the indented portion 12 are provided with a luminescent layer 13. The indented portion 12 accommodates a coil 20 which, together with a core 21 of a soft-magnetic material, forms means 2 for maintaining an electric discharge in the discharge space. A tube 14 having an inner surface 15 and an axis 16 extends concentrically within the indented portion 12. The tube 14, which has an internal diameter of 4.6 mm, communicates with the discharge space 10 via a mouth 14*a* at a free end 12*a* of the indented portion 12. The low-pressure discharge lamp further comprises a carrier 3 with a resilient body 30, which is clamped inside the tube 14. Apart from the resilient body 30, the carrier 3 has an open holder 31 (see opening 31'). The holder 31 contains mercury in the form of an amalgam 32 with the alloy BiIn. The holder has an external diameter of 2.9 mm.

Figure 2A:
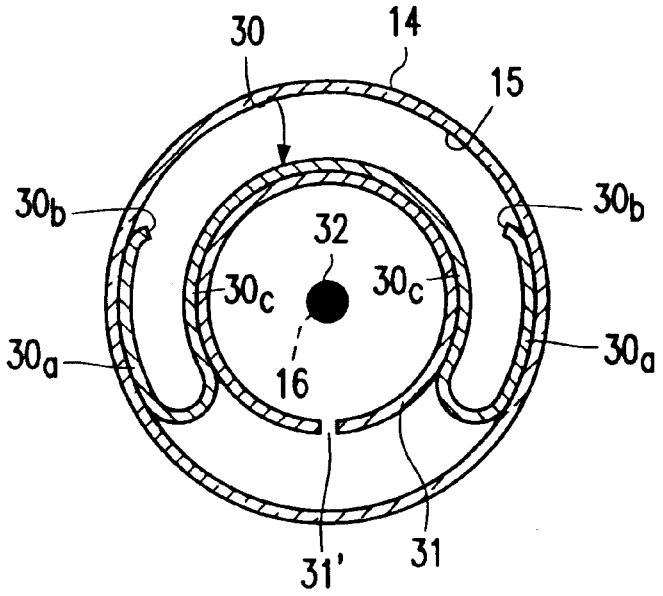
FIG. 2A is a cross-sectional plan view taken on the line II—II in FIG. 1.
Figure 2B:
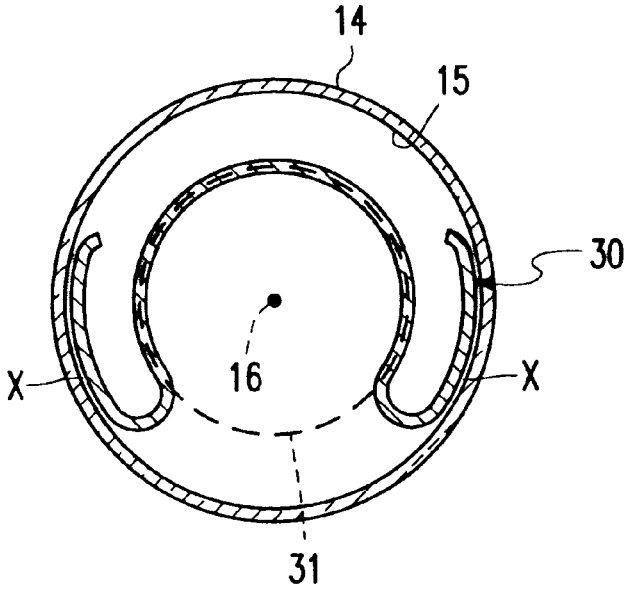
FIG. 2B is a corresponding cross-sectional view without the holder, the resilient body being in a released state.

FIG. 2A shows, in greater detail, that the holder 31 is clamped inside the resilient body 30. The holder 31 is clear of the inner surface 15 of the tube 14. As shown in FIG. 2B, in the absence of the holder 31, the resilient body 30 can be incorporated in a released state in the tube 14 with play x. In this Figure, the circumference of the holder 31 is represented by dashed lines.

In this case, for the resilient body 30 use is made of a strip having a width of 5 mm, which is bent so as to be Ω-shaped. The strip 30 is incorporated between the holder 31 and the tube 14.

The resilient body 30 contacts the tube 14 with portions 30*a* which are bent so as to be identical in shape to the inner surface of the tube, and said resilient body has inwardly directed end portions 30*b*.

Figure 3:
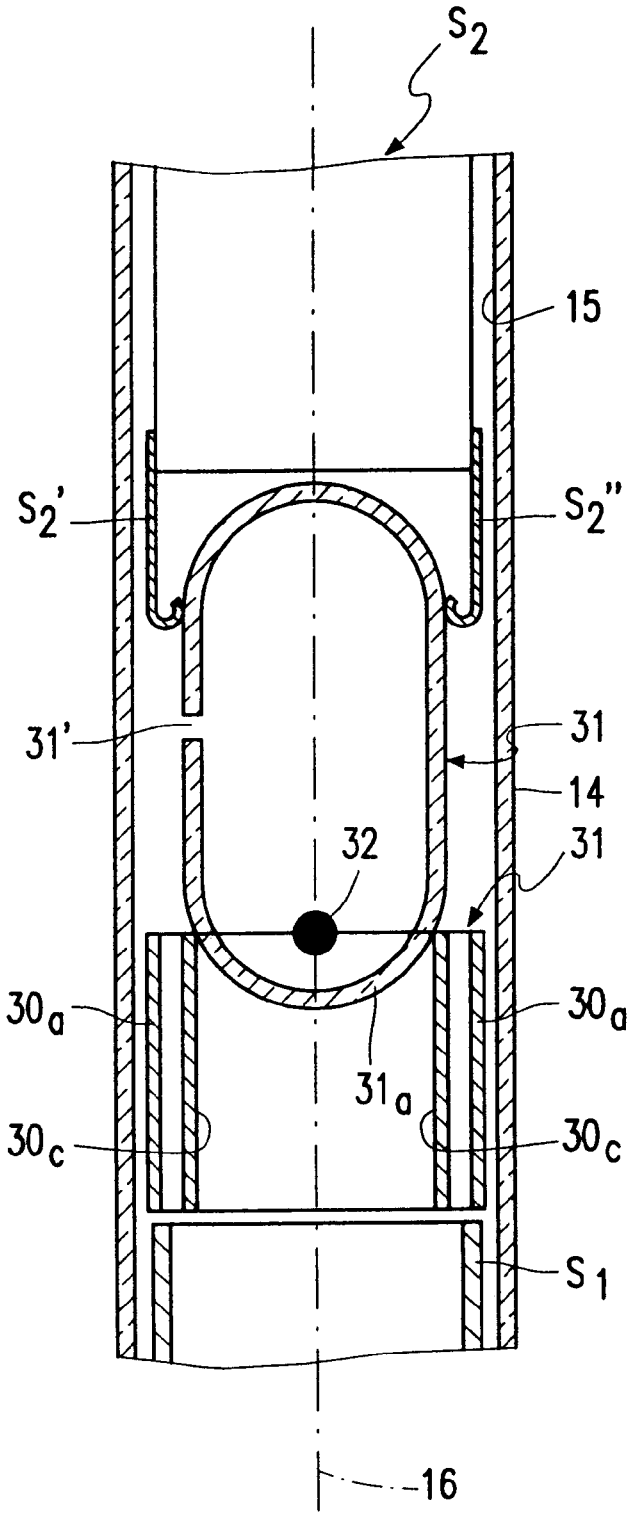
FIG. 3 shows a step in a method of manufacturing the lamp shown in FIG. 1

A method of manufacturing the low-pressure discharge lamp in accordance with the invention is explained by means of FIG. 3. In this method, the resilient body 30 is inserted into the tube 14 by means of a hollow stick S1. From the opposite direction, the holder 31 is inserted into the tube 14 by means of a solid stick S2. The holder 31 shown comprises the amalgam-forming alloy BiIn, referenced 32'. Resilient tongues S2', S2" are used to clamp the holder 31 to the solid stick S2. It is alternatively possible to use a hollow stick instead of a solid one, whereby there is a partial vacuum in the cavity of this stick. In a variant of the lamp to be manufactured, in which the holder is made of a ferromagnetic material, for example iron, the stick may have a magnetic end portion to hold the holder. As a result of gravity, the resilient body 30 rests on the hollow stick S1. If desired, also this stick may have a magnetic end portion. Subsequently, the resilient body 30 is held in the desired axial position relative to the tube 14. Next, the holder 31 is inserted further. The holder 31 and the resilient body 30 have mutually self-locating shapes since the holder 31 has a hemispherical end portion 31*a* facing the resilient body 30. As a result, the pressure exerted on the resilient body 30 during inserting the holder 31 causes the portions 30*c* of the resilient body 30 to spread outward in opposite directions. After the holder 31 is clamped in the resilient body 30, the sticks S1, S2 are removed from the tube 14. The clamping force of the resilient body 30 exceeds that of the resilient tongues S2', S2", so that after removal of the solid stick SI, the holder 31 remains secured in the resilient body 30. Subsequently, the tube 14 and other parts, that is, the indented portion 12 and the enveloping portion 11, are assembled so as to form a discharge vessel 1. At this stage, the enveloping portion 11 and the indented portion 12 are already provided with a luminescent layer 13. Subsequently, the discharge vessel 1 is evacuated via the tube 14. Next, the discharge vessel 1 is provided with a filling comprising an evaporable component, in this case mercury. For this purpose, a further, metal holder (not shown), which is provided with the mercury to be dosed, is introduced into the tube 14, between its free end 14*b* and the holder 31. Further, the discharge vessel 1 is provided with a noble gas, such as argon, via the tube 14. Subsequently, the tube 14 is closed. Next, the further holder is opened by means of high-frequency induction. Next, a portion of the tube containing the further holder is detached from the tube 14, whereafter the tube is closed again at the location of the resultant free end 14*b* as shown in FIG. 1. In another embodiment, the further holder is opened, for example, by means of a laser beam which is directed at the further holder through the wall of the tube 14. In this case, said further holder may alternatively be made of a metal or, for example, of glass or ceramic. Subsequently, the low-pressure discharge lamp is provided with means 2 for maintaining an electric discharge in the discharge space.

Figure 4A:
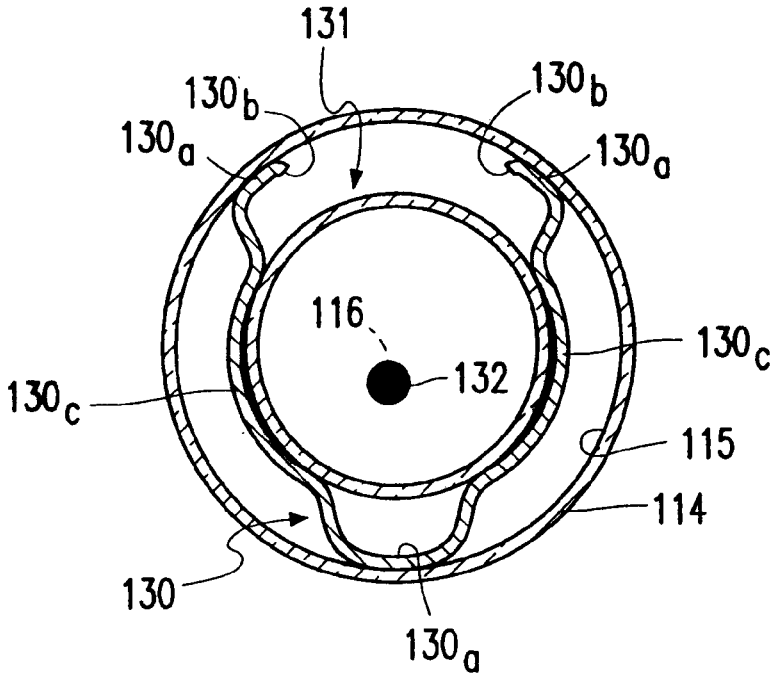
FIG. 4A is a cross-sectional view corresponding to that of FIG. 2A, of a second embodiment of the low-pressure discharge lamp.
Figure 4B:
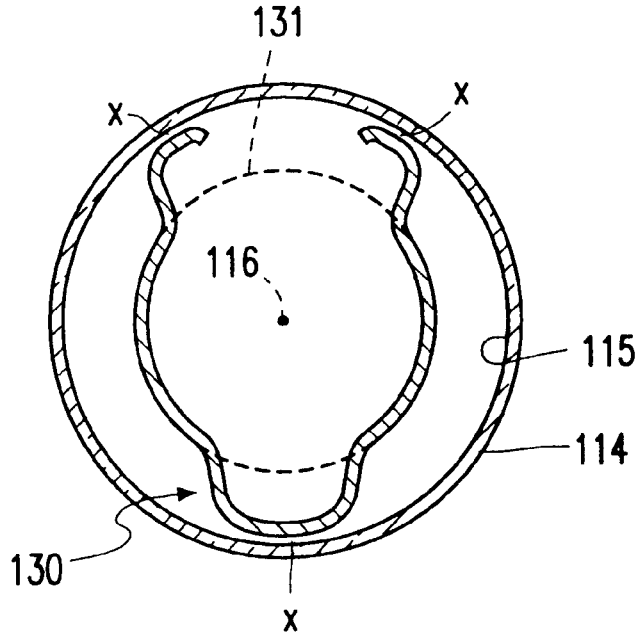
FIG. 4B is a corresponding cross-sectional view without the holder, the resilient body being in a released state.

FIGS. 4A and 4B show a detail, corresponding to that shown in FIGS. 2A and 2B, of a further embodiment of the lamp. In FIGS. 4A and 4B, parts corresponding to parts used in FIGS. 2A and 2B are indicated by reference numerals which are 100 higher. In this case, the resilient body 130 is a strip which is bent so as to be U-shaped, and which also has a width of 5 mm.

What is claimed is:

1. A low-pressure discharge lamp comprising a light-transmissive discharge vessel (1) which encloses a discharge space (10) with an ionizable filling in a gastight manner, which filling contains an evaporable component, said low-pressure discharge lamp further comprising means (2) for maintaining an electric discharge in the discharge space, and a carrier (3) with a resilient body (30) which is clamped inside a tube (14) which is in communication with the discharge space (10), said carrier (3) being suitable for containing said evaporable component, wherein the carrier (3) further comprises an open holder (31), which is clamped in the resilient body, and, in the absence of the holder, the resilient body being accommodated in a released state in the tube (14) with play (x).

2. A low-pressure discharge lamp as claimed in claim 1, characterized in that the resilient body (30) is a strip which is incorporated between the holder (31) and the tube (14).

3. A low-pressure discharge lamp as claimed in claim 1, characterized in that the resilient body (30) engages the tube (14) with portions (30*a*) which are bent so as to be identical in shape to the internal surface (15) of the tube, and said resilient body has inwardly directed end portions (30*b*).

4. A low-pressure discharge lamp as claimed in claim 3, characterized in that the holder (31) and the resilient body (30) have mutually self-locating shapes.

5. A method of manufacturing a low-pressure discharge lamp comprising:

a) inserting a resilient body (30) and a holder (31) into a tube (14) from mutually opposite directions, b) holding the resilient body (30) in the same axial position relative to the tube (14) while inserting the holder (31) further into the tube (14) until it is clamped into the resilient body (30), c) assembling the tube (14), an enveloping portion (11), and an intended portion (12) to form a discharge vessel (1), d) evacuating the discharge vessel (1), e) then providing the discharge vessel (1) with a filling comprising an evaporable component, f) then closing the tube (14), at a free end (14*b*) and g) providing the discharge lamp with means (2) for maintaining an electric discharge in a discharge space (10) of the discharge vessel (1).

6. A method as claimed in claim 5, characterized in that prior to evacuating the discharge vessel (1), the holder (31) is closed and contains the evaporable component, and said holder is opened after evacuation of the discharge vessel.

7. A method as claimed in claim 6, characterized in that after opening the holder (31), the evaporable component is expelled from said holder, whereafter a tube portion containing the holder and the resilient body is detached from the tube, after which a resultant free end portion of the tube is sealed.

* * * * *